US006857240B1

(12) United States Patent
MacAlister

(10) Patent No.: US 6,857,240 B1
(45) Date of Patent: Feb. 22, 2005

(54) CINDERBLOCK ALIGNMENT CLIP

(76) Inventor: Lawrence R MacAlister, 10 Josie La., Ashville, NC (US) 28804

( * ) Notice: Subject to any disclaimer, the term of this patent is extended or adjusted under 35 U.S.C. 154(b) by 0 days.

(21) Appl. No.: 10/350,730

(22) Filed: Jan. 24, 2003

(51) Int. Cl.[7] ..... E04B 1/02

(52) U.S. Cl. ..... 52/564; 52/562; 52/715; 52/442

(58) Field of Search ..... 52/596, 604, 562, 52/565, 568, 426, 713, 715, 698, 564, 442, 714

(56) References Cited

U.S. PATENT DOCUMENTS

| | | | | | |
|---|---|---|---|---|---|
| 384,541 | A | | 6/1888 | Palmer | |
| 2,235,646 | A | | 3/1941 | Schaffer | |
| 2,552,712 | A | | 5/1951 | Ellis | |
| 2,963,828 | A | | 12/1960 | Belliveau | |
| 3,036,407 | A | | 5/1962 | Dixon | |
| 3,144,733 | A | * | 8/1964 | Balinski | 52/714 |
| 3,274,742 | A | | 9/1966 | Raul, Jr. et al. | |
| 3,390,502 | A | | 7/1968 | Carroll | |
| 3,430,404 | A | | 3/1969 | Muse | |
| 3,936,987 | A | | 2/1976 | Calvin | |
| 4,417,431 | A | * | 11/1983 | Commins et al. | 52/715 |
| 4,454,699 | A | | 6/1984 | Strobl | |
| 4,703,603 | A | * | 11/1987 | Hills | 52/582.1 |
| 5,056,289 | A | * | 10/1991 | Colen | 52/564 |
| 5,252,017 | A | | 10/1993 | Hodel | |
| 5,297,889 | A | * | 3/1994 | Crouse et al. | 403/391 |
| 5,566,518 | A | * | 10/1996 | Martin et al. | 52/426 |
| 5,649,401 | A | * | 7/1997 | Harrington, Jr. | 52/426 |
| 5,820,305 | A | | 10/1998 | Taylor et al. | |
| 5,966,893 | A | * | 10/1999 | Quillin | 52/713 |

* cited by examiner

*Primary Examiner*—Naoko Slack
*Assistant Examiner*—Jennifer I. Thissell
(74) *Attorney, Agent, or Firm*—Michael I. Kroll

(57) ABSTRACT

A cinderblock alignment clip comprising a center plate having a first end and a second end. A first retaining arm having a first portion and a second portion, both the first portion and the second portion are connected to the first end. The first portion extends in a direction on a side of the center plate opposite the second portion. A second retaining arm having a third portion and a fourth portion, both the third portion and the fourth portion are connected to the second end. The third portion extends in a direction on a side of the center plate opposite the fourth portion. The first portion and the second portion are pivotable about the first end, and the third portion and the fourth portion are pivotable about the second end. The first side of the center plate is positionable on a side of a first cinder block, one of the first and second portions are pivoted against a first side of a wall of the cinderblock and one of the third and fourth portions are pivoted against a second side of the wall of the cinderblock.

7 Claims, 9 Drawing Sheets

CINDERBLOCK ALIGNMENT CLIP

BACKGROUND OF THE INVENTION

1. Field of the Invention

The present invention relates generally to alignment devices and, more specifically, to a clip for aligning layers of cinderblocks without placing mortar between the layers and adjacent blocks.

2. Description of the Prior Art

Numerous types of interlocking building implements have been provided in the prior art without widespread acceptance ion the industry. For example, U.S. Pat. Nos. 384,541; 2,235,646; 2,552,712; 2,963,828; 3,036,407; 3,274,742; 3,390,502; 3,430,404; 3,936,987; 4,454,699; 5,252,017; and 5,820,305 are all illustrative of such prior art. While these interlocking building implements may be suitable for the purposes for which they were designed, they would not be as suitable for the purposes of the present invention, as hereinafter described.

Disclosed is a hollow rectangular concrete building block having the projecting tongue D on its top and the groove C in its lower side, the tongue of one block fitting into the groove of the superimposed block, and the ends of the block being provided with a series of scallops or vertical corrugations extending entirely across the end thereof, substantially as described and shown.

Masonry comprising vertical courses of bricks having apertures of elongated cross-section and extending at an incline to the edges right through the brick and crossing the one the other in two superposed bricks, and separate solid dowels having each a smooth straight middle portion and tapering at both ends along at least one-fifth of the length and inserted in vertical position into the registering apertures of two superposed courses of superposed courses of bricks and held in position solely by friction on the walls of the apertures.

A wall construction, comprising a footing provided in its top with a wide chase, horizontal layers of unitary hollow blocks arranged upon the footing, each block including sides and ends forming a main recess, the sides of each block having a pair of vertical opposed spaced ribs formed upon their inner faces for providing reduced passages between the ribs, key-slabs for each layer of blocks and having substantially the width of the main recesses of the blocks and inserted within such recesses and engaging behind the ribs, the key-slabs of each layer having their lower ends projecting downwardly below the blocks and their upper ends terminating short of the tops of the blocks, the lower ends of the key-slabs of the lowermost layer extending into the chase and the lower ends of the key-slabs of each successive upper layer of blocks projecting into the upper ends of the main recesses of the next lower layer of blocks behind the ribs, and a concrete filling within the main recesses of the blocks and extending through the passages between the ribs to be bonded to the key-slabs.

Disclosed are rectangular building blocks, each of which is provided with intersecting grooves in the opposed horizontal faces and an aperture extending through the block from the bottom walls of the grooves at the intersections thereof and wherein means are provided for extension through said apertures and for disposition within said grooves for securing horizontally disposed abutting blocks in position.

The invention is a wall constructed of blocks of generally parallelepipedal form each having a pair of spaced parallel dowel holes opening through and normal to its top and bottom faces, said holed being symmetrically related to the respective ends of the block, and a plurality of dowel pins each having a stop flange between its ends and each fitting a respective hole with its flange abutting the lower face thereof, said pins having a length equal to the vertical dimension of the blocks plus the thickness of the joint between courses, each said pin extending below said flange by a distance greater than said thickness of joint.

An inclined conical refractory wall comprising burned refractory bricks laid in a conical course, each brick having a hot end and a cold end with sides extending longitudinally between the ends, the hot end forming an inner inclined conical wall surface with a cold end being substantially parallel thereto, said wall including a lower course of bricks and an upper course of bricks resting directly on the lower course of bricks, each brick of an upper course having an aperture in the lower side of the brick and a metallic projection, the projection including a tab extending downwardly from the cold end of the brick perpendicular to the lower side of the brick adapted to engage against the cold end of a brick of a lower course, a web extending inwardly therefrom along a recess in the lower side of the brick toward the hot end and a leg extending upwardly from the web parallel to the tab and resiliently wedged into the aperture in the lower side of the brick.

In a brick wall construction, a brick comprising a horizontally-elongated face portion and a bonding lug projecting horizontally and transversely from said face portion, said brick having generally-horizontal upper and lower surfaces common to the face portion and to said lug, and being formed in said surfaces respectively with vertically-registering trios of sockets, each said trio being arranged to define the three corners of an isosceles triangle, said triangle being in relatively-spaced parallel planes, the sockets of the upper said surface all being of similar circular cross-sectional shape and proportioned for encircling line engagement with uniformly-dimensioned spherical keys along circles of contact of similar diameter disposed in a common horizontal plane of the brick, to support said keys in fixed triangular disposition with their centers concentric to the respective sockets in a common horizontal plane above said upper surface; the sockets of the other said surface having flat bottoms disposed in a common horizontal plane for engagement with said respective keys, and being of lesser depth than the radius of said keys, said last-mentioned sockets including encircling side walls proportioned to permit reception of said keys in abutting relation to the socket bottoms despite slight variations in the relative horizontal positions of said keys.

In an apertured wall structure, the combination of a plurality of rectangular blocks assembled in spaced end to end relationship in horizontal courses of blocks with the middle one-third portions of the blocks of each course of blocks overlaying the spaces between the blocks of the next adjacent lower course, each of said blocks defining a recess extending from its bottom surface up into its middle one-third portion, and each of said blocks including substantially vertically extending circular apertures of substantially constant cross sectional area along at least a major portion of their lengths centrally located in the end one-third portions of each block, counterbores defined in at least one surface of each block about its apertures, a plurality of cylindrical resilient metallic opened ended sleeves each including a slot from end to end along its length and a generally annular external protrusion intermediate its ends, said blocks of each course having their apertures aligned with the apertures of the blocks 9*n* the next adjacent course, and said sleeves positioned in the apertures at the juncture of blocks in adjacent courses of blocks and extending less than one-half the distance through adjacent blocks, with the annular protrusion of each sleeve being positioned in the counterbore of at least one of the blocks.

A concrete block simulating a Norman brick is formed with two large cores separated by a central web. The cores are adapted to receive insulating foam during manufacturing of the block. Each block is grooved in its opposite ends and recessed in its central web for the reception of wedge elements or keys formed of plastic or the like. Adjacent blocks in each course are interlocked and the courses of walls constructed from the blocks in either a stacked bond or running bond are mechanically interlocked and properly aligned. Epoxy cement is utilized for bonding of courses in a customized wall or in prefabricated panel sections utilizing the interlocking block.

A device for connecting bricks which have apertures to receive the device is provided. A support shaft of the supports resilient transverse fins which form an interference fit with the aligned apertures of two adjacent bricks. Stop surfaces on the support shaft engage the respective bricks to ensure penetration of both bricks. Flared ends of the device facilitate insertion and centering of the device within the apertures and provide protection for the fins. During insertion, the transverse fins are deflected inward toward the support shaft and longitudinally toward the stop surfaces. After insertion, the fins are biased outward by their resiliency into engagement with the bricks to lock the adjacent bricks together.

A mortarless concrete block retaining wall is formed from special blocks arranged in setback tiers and interlocked by special offset pins. Each block is trapezoidal in plan view with a pair of vertical holes behind a relatively wide front face. The holes in adjacent tiers are laterally offset. The pins have opposite end sections which are laterally offset from one another and fit respectively in the offset holes to interlock adjacent tiers in setback relation. The special pins are rotatably adjustable to interlock the tiers in a straight configuration or in varying degrees of convex and concave curved configurations.

A precast concrete block having a first single thickness generally planar face section and a second single thickness generally planar backing section integrally formed with and extending from the first section to form a structure of a T-shaped configuration. A groove extends across and opens through an upper edge of the second planar section for the receipt of a rebar. The blocks are assembled into stacked side-by-side relationship and a panel is formed by casting concrete against the side of the generally planar face sections from which the backing sections extend. Rebar extends across and through the grooves of at least certain of the blocks to maintain the blocks in aligned side-by-side relationship and reinforce the concrete cast against the blocks. The panels are used in the construction of retaining walls for earthen formations and may be precast or formed in place at the situs of the formations. When used in the construction of retaining walls, vertical rebars extend into the cast concrete from a foundation supporting the panels and connectors may be provided to secure the panels to anchor elements within the earthen formation.

The present invention relates generally to alignment devices and, more specifically, to a clip for aligning layers of cinderblocks without placing mortar between the layers and adjacent blocks.

A primary object of the present invention is to provide an alignment clip for laying cinderblocks that overcomes the shortcomings of the prior art.

Another object of the present invention is to provide an alignment clip that can be used by unskilled laborers to lay cinderblock walls.

Yet another object of the present invention is to provide an alignment clip that ensures vertical alignment between successive rows of cinderblocks.

Still yet another object of the present invention is to provide an alignment clip that eliminates the need for placing mortar between the rows of and the adjacent cinderblocks.

A further object of the present invention is to provide an alignment clip that obviates the need for an external geometric measuring device for determining level placement of sequential courses of cinderblocks.

Another object of the present invention is to provide an alignment clip that reduces the labor force necessary to construct structures using cinderblocks.

Yet another object of the present invention is to provide an alignment clip that reduces the time needed to construct structures using cinderblocks.

Still yet another object of the present invention is to provide an alignment clip that provides consistent vertical spacing between cinderblocks.

Yet another object of the present invention is to provide an alignment clip having an upper channel and a lower channel formed by a planar arrangement of walls having a predetermined space therebetween.

Another object of the present invention is to provide an alignment clip having spaces extending through a middle section for allowing filler material to fill the cavities of the cinderblock and the spaces therebetween.

Additional objects of the present invention will appear as the description proceeds.

The alignment device of the present invention is a clip having a planar surface with raised portions on opposing sides for positioning between cinderblocks for spacing apart thereof at a predetermined distance.

In addition to the raised portions formed in the center, the top surface has spaced apart walls forming a channel and the bottom surface has spaced apart walls forming a channel with each of the channels spaced apart walls conforming in distance to the wall thickness of a cinderblock.

The top and bottom clip channels are vertically aligned, causing the top most row to be plumb with the bottom most row thereby allowing unskilled labor can be used to construct walls.

In addition to providing an equidistant spacing between courses of cinderblock, the space created by the raised portions in the planar surface also provides a gap through which air may escape from the central cavity between the cinderblocks as a filler material, such as concrete, is pumped therein, thus allowing the concrete to fill the spaces between the blocks without air gaps therein.

The present invention overcomes the shortcomings of the prior art by providing a cinderblock alignment clip providing means for layering cinderblocks without the need for mortar placed between the layers and adjacent blocks while making use of the normative cinderblocks preferred at a majority of construction sites. Eliminating the need for mortar while laying the cinderblocks allows for quick work of the stacking of multiple courses of cinderblock. The alignment clip has a planar surface with raised portions on opposing sides so that when the clip is positioned between cinderblocks, the blocks are spaced away from each other by a predetermined distance equal to the height of the raised portion on one side plus the height of the raised portion of the other side. In providing a constant space between blocks, ensures a level top surface consistent with an initial leveling measurement made prior to the first course of cinderblock.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 1:
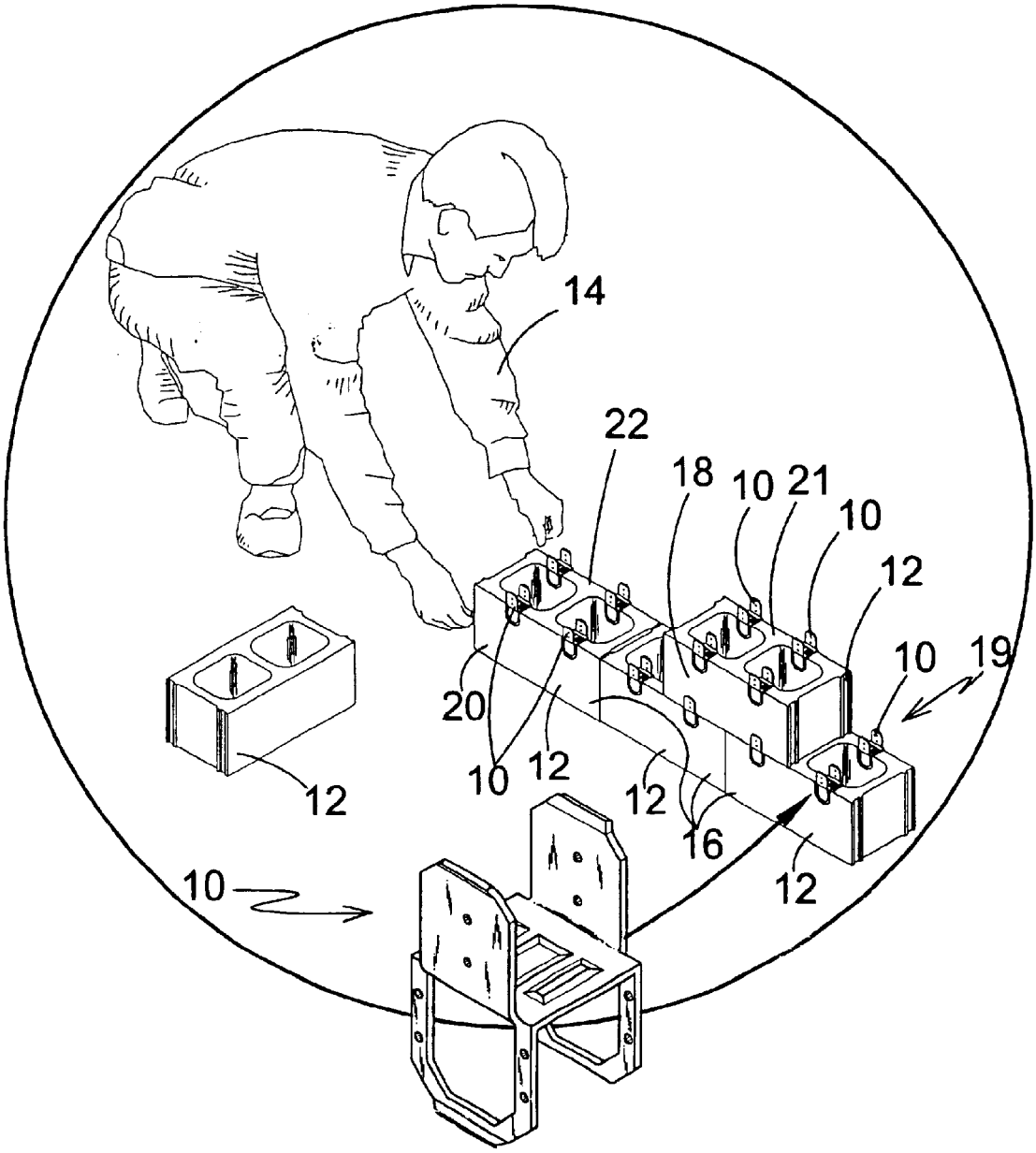
FIG. 1 is an illustrative view of the cinderblock alignment clip of the present invention in use aligning a second course of cinderblocks atop a first course of cinderblocks.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to those skilled in the art to practice the invention, and it is to be understood that other embodiments may be utilized and that structural changes may be made without departing from the scope of the invention. In the accompanying drawings, like reference characters designate the same or similar parts throughout the several views.

DESCRIPTION OF THE REFERENCED NUMERALS

Turning now descriptively to the drawings, in which similar reference characters denote similar elements throughout the several views, the Figures illustrate the electric vehicle of the present invention. With regard to the reference numerals used, the following numbering is used throughout the various drawing figures.

10 cinderblock alignment clip of the present invention
12 cinderblock
14 user
16 first course
18 second course
19 cinderblock wall
20 first side of wall
21 top surface of wall
22 second side of wall
24 center plate
26 first retaining arm
28 second retaining arm
30 first side
32 second side
34 first end
36 second end
38 first crease
40 second crease
42 first spacer
44 second spacer
46 first dividing-cut
48 first interior retaining arm
50 first exterior retaining arm
52 first exterior lip
54 first interior lip
56 second dividing-cut
58 second interior retaining arm
60 second exterior retaining arm
62 first exterior lip
64 second exterior lip
66 interior gripping knobs
68 exterior gripping knobs
70 first chamber
71 first cavity
72 second chamber
74 first side-wall of a cinderblock
73 second cavity
75 top surface of a cinderblock
76 second sidewall of a cinderblock
78 first end wall of a cinderblock
80 second end wall of a cinderblock

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views, FIGS. 1 through 9 illustrate the cinderblock alignment clip of the present invention indicated generally by the numeral 10.

FIG. 1 is an illustrative view of the cinderblock alignment clip 10 of the present invention (hereinafter "clip") being used by a laborer 14 for aligning a second course 18 of cinderblocks 12 atop a first course 16 of cinderblocks 12 to form a cinderblock wall 19. Currently, the laying of cinderblocks 12 requires a skilled mason to place the cinderblocks 12 with a layer of mortar therebetween. Manipulating mortar between the cinderblocks 12 requires a skilled hand and the monitoring for levelness of the top surface 21 of the wall 19 upon laying each new course of cinderblocks 12. Furthermore, a second course 18 of cinderblocks 12 must be aligned directly above the first course 16 of cinderblocks 12 creating a flush first and second side of the wall, 20 and 22 respectively. If the cinderblocks 12 are misaligned with a bias toward the first side of the wall 20, the wall 19 will tend to fall toward that side. If the cinderblocks 12 are misaligned with a bias the second side of the wall 22 the wall 19 will have a tendency to topple toward that side. Cinderblock walls 19 are built as a foundation to support a superstructure and therefore the sound vertical alignment of the wall 19 is dependent upon a level top surface 21.

Figure 2:
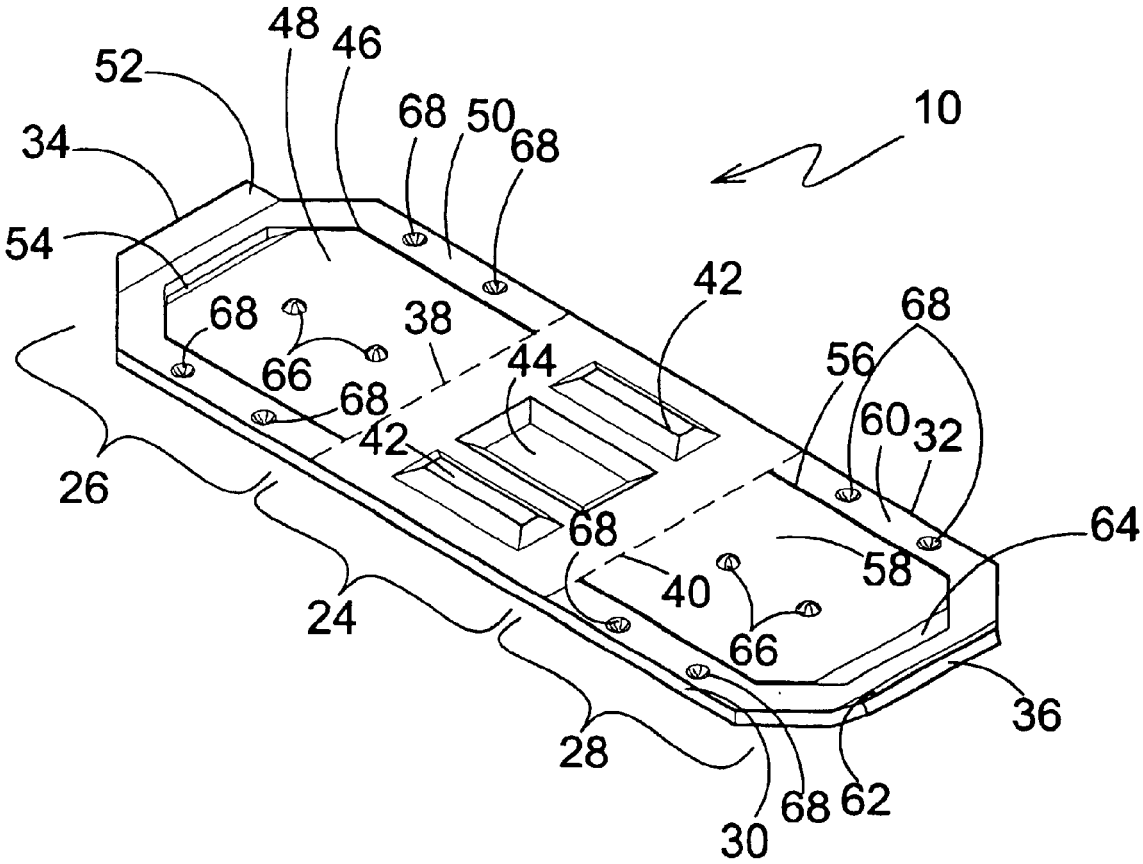
FIG. 2 is a perspective view of the cinderblock alignment clip of the present invention as a flat plate.

FIG. 2 is a perspective view of the cinderblock alignment clip 10 of the present invention as a flat plate. Preferably, the clip 10 of the present invention is formed from a metal. However, any material that is able to align cinderblocks and provide a space therebetween can be used. The clip 10 is formed by stamping a pattern into a flat plate of metal. The plate is stamped in order to form the clip 10 of the present invention and has a first side 30, a second side 32, a first end 34, and a second end 36. The clip 10 contains a center plate 24, a first arm 26, and a second arm 28. The clip has a first and second crease, 38 and 40 respectively. The center plate 24 is located between the first crease 38 and the second crease 40. The center plate 24 has a diameter substantially the same as the width of an external wall of a cinderblock 12. Cinderblocks differ in size and shape and the clip 10 can be manufactured to conform thereto. An appropriately sized clip 10 would be selected with a central plate 24 having properly sized to fit the particular cinderblock 12. The center plate 24 has a first and second side. Positioned on the first side of the center plate 24 is a first spacer 42. Positioned on a second side of the center plate is a second spacer 44. The first spacer 42 extends vertically from the surface of the first side of the center plate 24 at a predetermined distance therefrom. The second spacer 44 extends from the surface of the second side of the center plate 24 at a predetermined distance therefrom. When the clip is positioned atop a cinderblock 12, the spacers, 42 and 44 respectively, cause a space to exist between the first course 16 of cinderblocks 12 and the second course 18 of cinderblocks 12 thereby allowing for air and other fluids to move between the cinderblock and the clip 10 and also providing a stable surface for the cinderblocks to rest upon.

The first retaining arm 26 is formed by the boundaries of the first side 30, the second side 32, the first crease 38 extending perpendicularly therebetween, and the first end 34. A three sided dividing cut 46 is stamped into the first retaining arm 26 substantially tracing the boundary thereof. The dividing cut 46 does not include the crease 38. The three-sided dividing-cut 46 separates the first retaining arm 26 into an interior retaining arm 48 and an exterior retaining arm 50. The dividing-cut 46 is placed at a predetermined distance from the peripheral boundary of the first retaining arm 26 so that the interior and exterior retaining arms, 48 and 50 respectively, are capable of maintaining their shape and structural integrity when separated from each other. The boundary of the exterior retaining arm 50 formed by the first end 34 is stamped to form a first exterior lip 52, as illustrated the first exterior lip 52 extends from the surface of the clip 10 at some angle less than ninety degrees to the horizon of the surface of the clip 10. Similarly the boundary of the interior retaining wall 48 that substantially traces the first end 34 is pressed to form a first interior lip 54. The first interior lip 54 also extend from the surface of the clip at an angle less than 90 degrees, however in a direction opposite that of the first exterior lip 52.

The second retaining arm 28 is formed by the boundaries of the first side 30, the second side 32, the second crease 40 extending perpendicularly therebetween, and the second end 36. A three-sided cut 56 is stamped into the second retaining arm 26 substantially tracing the boundary thereof. The cut 56 does not include the second crease 40. The three-sided cut 56 separates the second retaining arm 28 into an interior retaining arm 58 and an exterior retaining arm 60. The cut 56 is placed at a predetermined distance from the peripheral boundary of the second retaining arm 28 so that the interior and exterior retaining arms, 58 and 60 respectively, are capable of maintaining their shape when separated from each other, the reasons for which will be later described. The boundary of the exterior retaining arm 60 formed by the second end 36 is stamped to form a second exterior lip 62, as illustrated the second exterior lip 62 extends from the surface of the clip 10 at some angle less than ninety degrees to the horizon of the surface of the clip 10 in the same direction as the first exterior lip 52. Similarly the boundary of the interior retaining wall 58 that substantially traces the second end 36 is pressed to form a second interior lip 64. The second interior lip 64 also extend from the surface of the clip at an angle less than 90 degrees, however in a direction opposite that of the second exterior lip 62 and the same as the first interior lip 54.

On the surface of the clip 10 are a plurality of surface tension knobs 66, 68. Within the surface area of the first and second interior retaining walls, 48 and 50 respectively, the knobs 66 extend vertically from the surface of the clip 10 in a direction opposite that of the first and second interior lips, 54 and 64 respectively. Likewise, within the surface area of the first and second exterior retaining walls, 50 and 60 respectively, the knobs 68 extend vertically from the surface of the clip 10 in a direction opposite that of the exterior lips 52 and 62.

Figure 3:
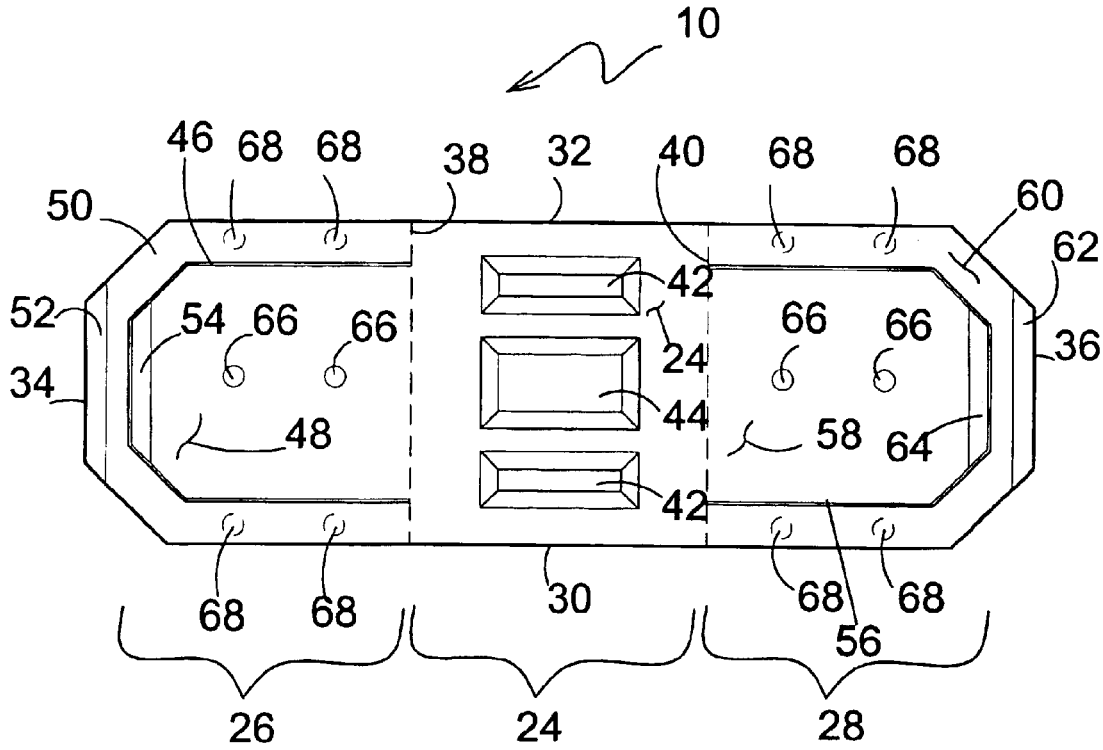
FIG. 3 is a top view of the cinderblock alignment clip of the present invention.

FIG. 3 is a top view of the cinderblock alignment clip 10 of the present invention. Preferably, the clip 10 of the present invention is formed from a metal. However, any material that is able to align cinderblocks and provide a space therebetween can be used. The clip 10 is formed by stamping a pattern into a flat plate of metal. The plate is stamped in order to form the clip 10 of the present invention and has a first side 30, a second side 32, a first end 34, and a second end 36. The clip 10 contains a center plate 24, a first arm 26, and a second arm 28. The clip has a first and second crease, 38 and 40 respectively. The center plate 24 is located between the first crease 38 and the second crease 40. The center plate 24 has a diameter substantially the same as the width of an external wall of a cinderblock 12. Cinderblocks differ in size and shape and the clip 10 can be manufactured to conform thereto. An appropriately sized clip 10 would be selected with a central plate 24 having properly sized to fit the particular cinderblock 12. The center plate 24 has a first and second side. Positioned on the first side of the center plate 24 is a first spacer 42. Positioned on a second side of the center plate is a second spacer 44. The first spacer 42 extends vertically from the surface of the first side of the center plate 24 at a predetermined distance therefrom. The second spacer 44 extends from the surface of the second side of the center plate 24 at a predetermined distance therefrom. When the clip is positioned atop a cinderblock 12, the spacers, 42 and 44 respectively, cause a space to exist between the first course 16 of cinderblocks 12 and the second course 18 of cinderblocks 12 thereby allowing for air and other fluids to move between the cinderblock and the clip 10 and also providing a stable surface for the cinderblocks to rest upon.

The first retaining arm 26 is formed by the boundaries of the first side 30, the second side 32, the first crease 38 extending perpendicularly therebetween, and the first end 34. A three sided dividing-cut 46 is stamped into the first retaining arm 26 substantially tracing the boundary thereof. The dividing cut 46 does not include the crease 38. The three-sided dividing-cut 46 separates the first retaining arm 26 into an interior retaining arm 48 and an exterior retaining arm 50. The dividing-cut 46 is placed at a predetermined distance from the peripheral boundary of the first retaining arm 26 so that the interior and exterior retaining arms, 48 and 50 respectively, are capable of maintaining their shape and structural integrity when separated from each other. The boundary of the exterior retaining arm 50 formed by the first end 34 is stamped to form a first exterior lip 52, as illustrated the first exterior lip 52 extends from the surface of the clip 10 at some angle less than ninety degrees to the horizon of the surface of the clip 10. Similarly the boundary of the interior retaining wall 48 that substantially traces the first end 34 is pressed to form a first interior lip 54. The first interior lip 54 also extend from the surface of the clip at an angle less than 90 degrees, however in a direction opposite that of the first exterior lip 52.

The second retaining arm 28 is formed by the boundaries of the first side 30, the second side 32, the second crease 40 extending perpendicularly therebetween, and the second end 36. A three-sided cut 56 is stamped into the second retaining arm 26 substantially tracing the boundary thereof. The cut 56 does not include the second crease 40. The three-sided cut 56 separates the second retaining arm 28 into an interior retaining arm 58 and an exterior retaining arm 60. The cut 56 is placed at a predetermined distance from the peripheral boundary of the second retaining arm 28 so that the interior and exterior retaining arms, 58 and 60 respectively, are capable of maintaining their shape when separated from each other, the reasons for which will be later described. The boundary of the exterior retaining arm 60 formed by the second end 36 is stamped to form a second exterior lip 62, as illustrated the second exterior lip 62 extends from the surface of the clip 10 at some angle less than ninety degrees to the horizon of the surface of the clip 10 in the same direction as the first exterior lip 52. Similarly the boundary of the interior retaining wall 58 that substantially traces the second end 36 is pressed to form a second interior lip 64. The second interior lip 64 also extend from the surface of the clip at an angle less than 90 degrees, however in a direction opposite that of the second exterior lip 62 and the same as the first interior lip 54.

On the surface of the clip 10 are a plurality of surface tension knobs 66, 68. Within the surface area of the first and second interior retaining walls, 48 and 50 respectively, the knobs 66 extend vertically from the surface of the clip 10 in a direction opposite that of the first and second interior lips, 54 and 64 respectively. Likewise, within the surface area of the first and second exterior retaining walls, 50 and 60 respectively, the knobs 68 extend vertically from the surface of the clip 10 in a direction opposite that of the exterior lips 52 and 62.

Having the clip 10 manufactured as a flat metallic plate allows for the clip 10 to be manufactured inexpensively and is easily manipulated from its flat form into its functional structure. This transformation from a flat-plat to a functional alignment implement will be discussed hereinafter with specific reference to FIG. 4.

Figure 4:
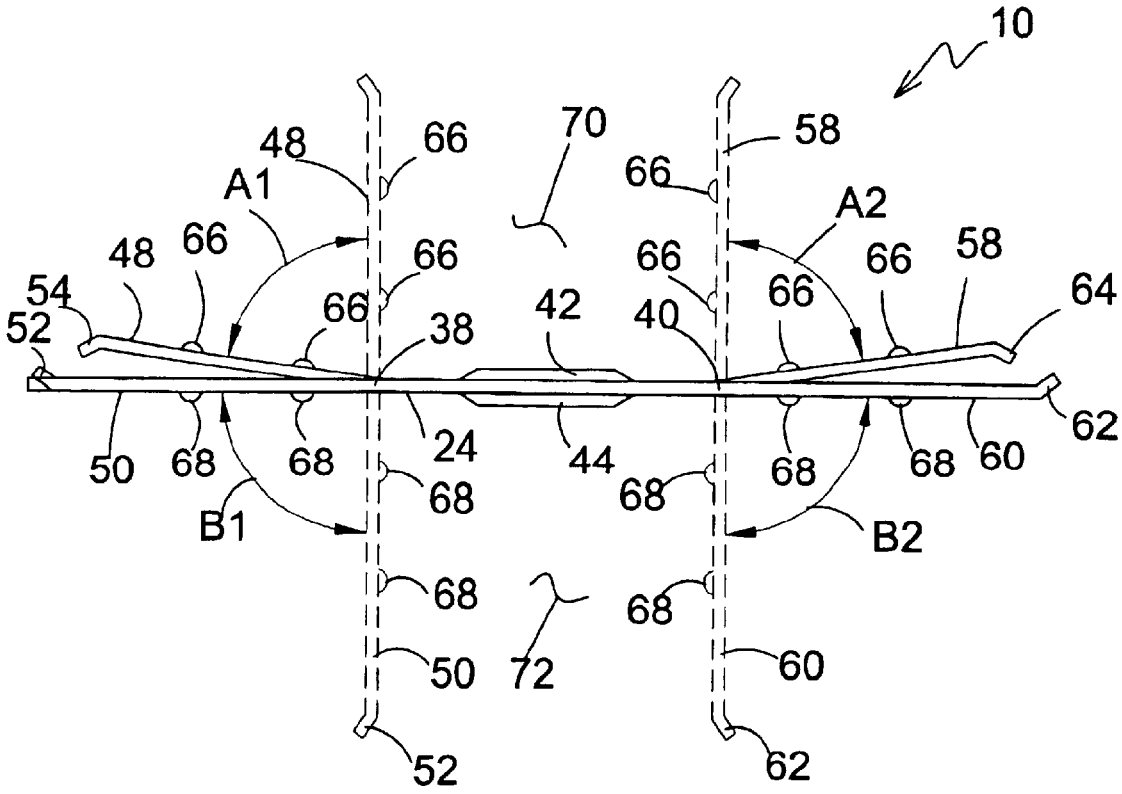
FIG. 4 is a side view of the cinderblock alignment clip of the present invention.

FIG. 4 is a side view of the clip 10 of the present invention being manipulated from a substantially flat plate into a functional clip 10. The clip 10 has a first chamber 70 and a second chamber 72. The first chamber 70 is formed by pivoting the first interior retaining wall 48 about the crease 38 and pivoting the second interior retaining wall 58 about the crease 40. The first interior retaining wall pivots about the crease 38 in the direction indicated by arrow labeled A1. The second interior retaining wall 58 pivots about the crease 40 in the direction indicated by the arrow labeled A2. The interior retaining walls, 48 and 58, are pivoted about their respective creased end, 38 and 40 until the retaining walls, 48 and 58, are positioned substantially perpendicular to the center plate 24. The first chamber 70 is the space between the center plate 24 and the first and second interior retaining walls, 48 and 58 respectively, positioned substantially perpendicular to the center plate 24.

The second chamber 72 is formed by pivoting the first exterior retaining walls 50 about the crease 38 and pivoting the second exterior retaining wall 60 about the crease 40. The first exterior retaining wall 50 pivots about the crease 38 in the direction indicated by arrow labeled B1. The second exterior retaining wall 60 pivots about the crease 40 in the direction indicated by the arrow labeled B2. The exterior retaining walls, 50 and 60, are pivoted about their respective creased end, 38 and 40 until the retaining walls are substantially perpendicular to the center plate 24. The second chamber 72 is the space between the center plate 24 and the first and second exterior retaining walls, 50 and 60 respectively, positioned substantially perpendicular to the center plate 24.

The chambers, 70 and 72 include gripping knobs 66 and 68 extending vertically from the retaining arms into the chambers, 70 and 72 respectively, for gripping the concrete surface of a cinderblock 12 placed therein. Additionally, the retaining walls, (48, 50, 58, and 60) are pivoted about the creases 38 and 40 in a direction that places the exterior lips 62 and 64 of the exterior retaining arm 50 and 60 to be in a position to pivot away from the center of their respective chamber. The interior lips, 52 and 54 of the interior retaining arms are pivoted about the creases 38 and 40 to be in a position to pivot away from the center of their respective chamber. This creates a wide opening for the chambers 70 and 72 thereby allowing the easy insertion of a cinderblock therein. The spacers 42 extend into the chamber 70 from the center plate 24. The spacers 44 extend into the chamber 72 from the center plate 24. The spacers, 42 and 44, create a gap between a first cinderblock 12 received by the chamber 70 and a second cinderblock 12 received by the second channel 72.

Figure 5:
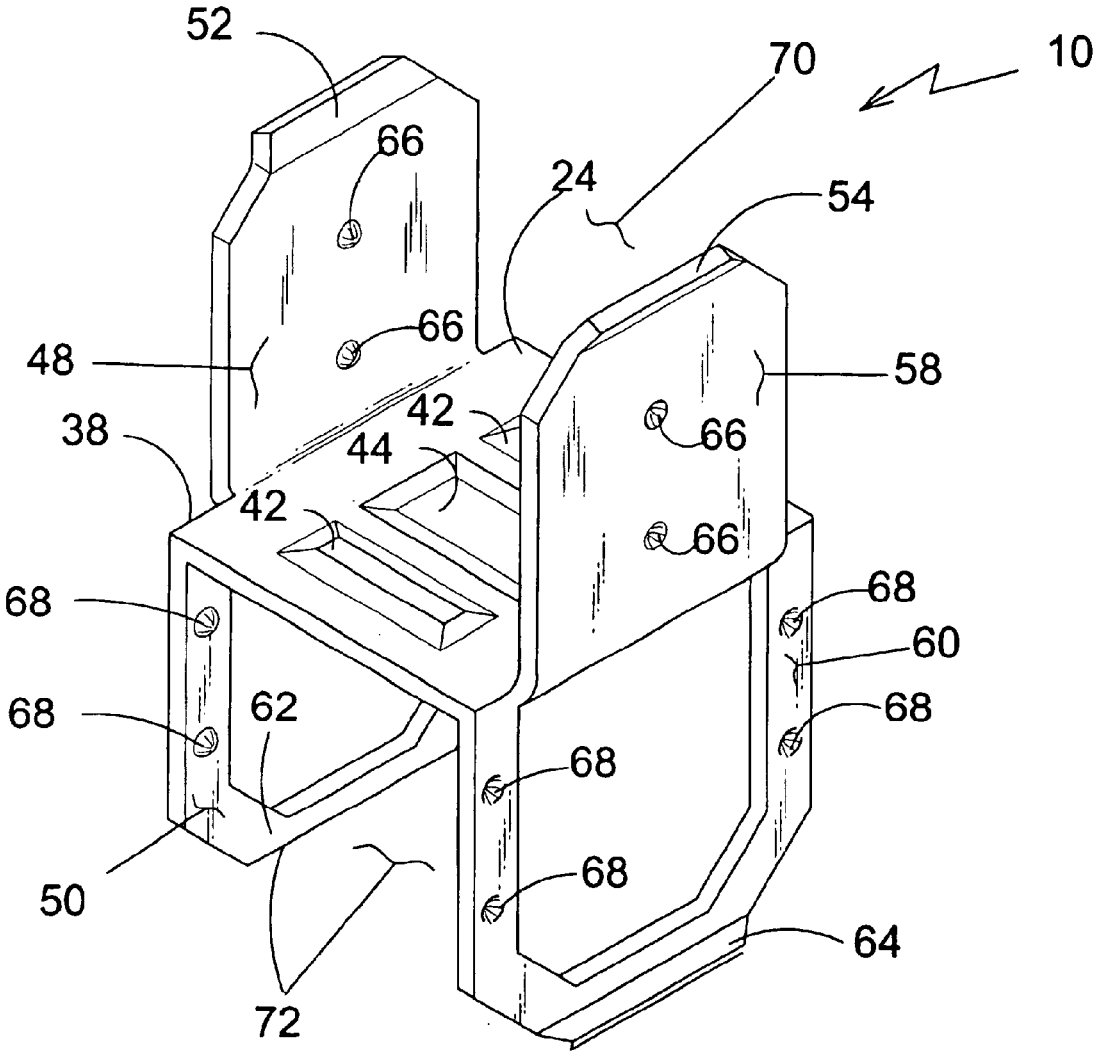
FIG. 5 is a perspective view of the cinderblock alignment clip of the present invention.

FIG. 5 is a perspective view of the cinderblock alignment clip 10 of the present invention in its manipulated form. The clip 10 includes a first chamber 70 and a second chamber 72. The first chamber 70 is formed by the first interior retaining arm 48, the second interior retaining arm 58, and the center plate 24. The first and second retaining arms, 48 and 58 respectively, extend substantially perpendicular to the center plate 24. At an end of the first interior retaining arm 48 opposite the center plate 24 the interior retaining arms 48 is bent away from the center of the first cavity 70 thereby forming the first interior lips 54. At an end of the second interior retaining arms 54 opposite the center plate 24 the second interior retaining arm 58 is bent away from the center of the first cavity 70 thereby forming second interior lips 64. The lips, 54 and 64, create an opening which is wider than the width of the first cavity 70, thus allowing for the easy insertion of cinderblocks therein. On each interior retaining arm, 48 and 58, is a plurality of gripping knobs 66 extending vertically into the first cavity 70. The gripping knobs 66 ensure a snug fit and add surface tension for grabbing a cinderblock placed within the first chamber 70. A first spacer 42 vertically extends into the first cavity 70 from the center plate 24. When the cinderblock is placed within the first chamber 70, the cinderblock will rest upon the first spacer 42 thereby leaving a gap between the cinderblock and the center plate 24 for air and other fluids to pass therebetween.

The second chamber 72 is formed by the first exterior retaining arm 50, the second exterior retaining arm 60, and the center plate 24. The first and second external retaining arms, 50 and 60 respectively, extend substantially perpendicularly from the center plate 24 in a direction opposite the first interior retaining arms. At the end of the first exterior retaining arm 50 opposite the center plate 24, the first exterior retaining arm 50 is bent away from the center of the second cavity 72, forming the first exterior lip 62. At the end of the second exterior retaining arm 60 opposite the center plate 24 the second exterior retaining arm 60 are bent away from the center of the second cavity 72 forming the second exterior lips 64. The exterior lips, 62 and 64, create an opening which is wider than the width of the second cavity 72 thereby allowing for the easy insertion of a cinderblock therein. On each exterior retaining arm, 62 and 64, is a plurality of gripping knobs 68 extending into the second cavity 72. The gripping knobs 68 ensure a snug fit and add surface tension for grabbing a cinderblock placed within the second chamber 72. A second spacer 44 extends vertically into the second chamber 72 from the center plate 24. When the wall of a cinderblock is placed within the second chamber 72, the cinderblock will rest upon the second spacer 44. This gap created by the second spacer 44 between the cinderblock and the center plate 24 allows air and other fluids to pass therebetween. The center plate 24 serves as a common divider between the first and second chambers, 70 and 72 respectively, with the second chamber 72 positioned directly opposite the first chamber 70.

Figure 6:
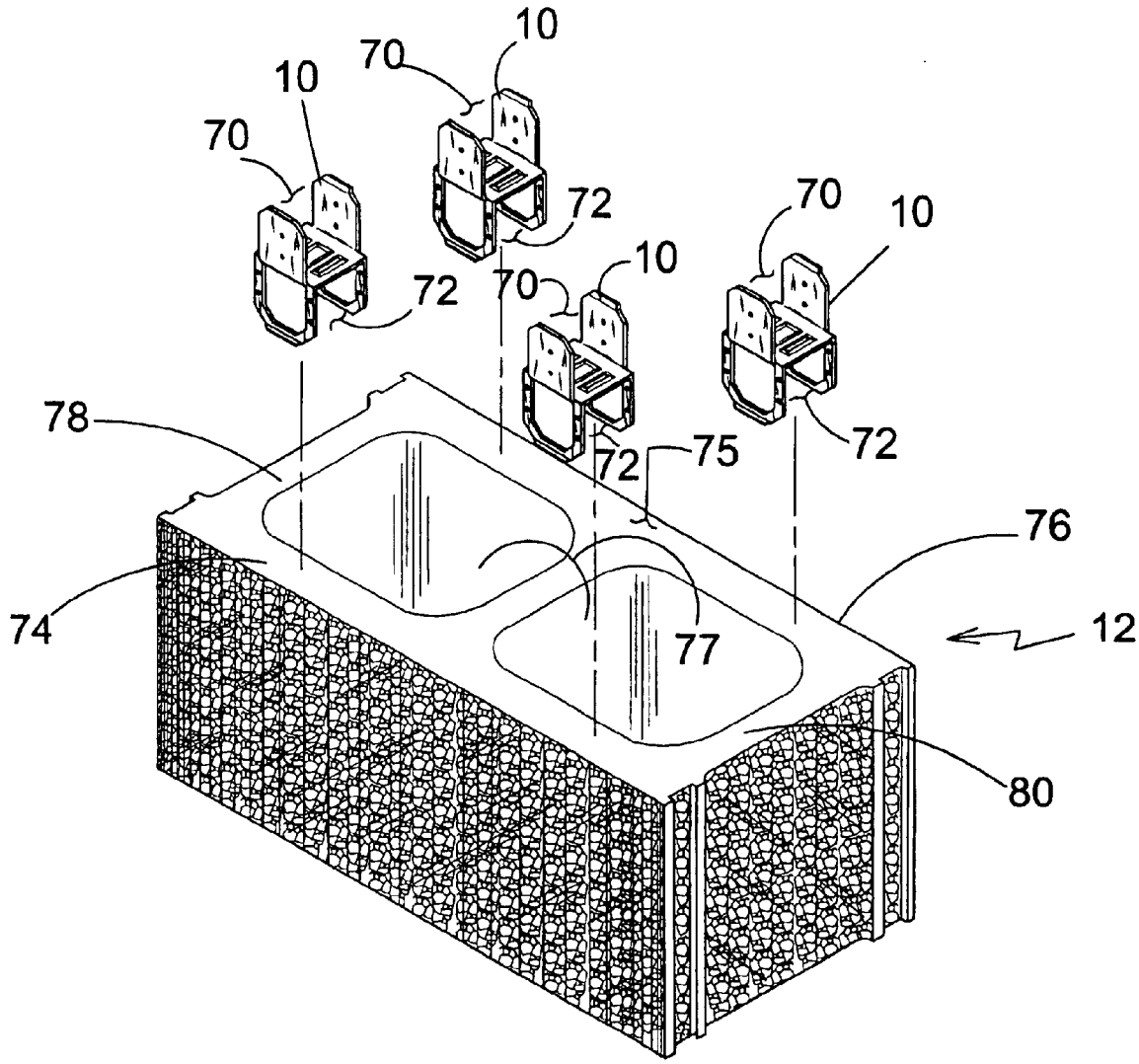
FIG. 6 is a perspective view of the cinderblock alignment clip of the present invention being aligned on a side of a cinderblock.

FIG. 6 is a perspective view of the cinderblock alignment clip 10 of the present invention in its manipulated form being aligned with the walls of a cinderblock 12. A conventional cinderblock 12 has a first side wall 74, a second side wall 76, a first end wall 78 and a second end wall 80. The first end wall 78 is positioned perpendicularly at a first end of and between the first side wall 74 and second side wall 76. The second end wall 80 is positioned perpendicularly at an end opposite the first end and between the first side wall 74 and second side wall 76. A middle wall is positioned perpendicularly between the first side wall 74 and the second side wall 76 and equidistant from the first end wall 78 and the second end wall 80 thereby creating a first cavity 71 and a second cavity 73. The first and second cavity 71, 73 may be filled with a binding agent for adding structural integrity thereto. Incorporation of the clip 10 with a cinderblock 12 requires the alignment of the second chamber of the clip 10 with a respective side wall 74, 76 of the cinderblock 12. Preferably a laborer 14 uses four clips 10 per cinderblock 12. The second channel 72 of the clip 10 receives a side wall 74, 76 of the cinderblock 12. The spacers 44 on the second side of the center plate 24 rests atop a top side 75 of the wall 74, 76 and the gripping knobs 68 of the first exterior arm 50 and second exterior arm 60 grip against the side wall 74, 76 of the cinderblock 12.

Figure 7:
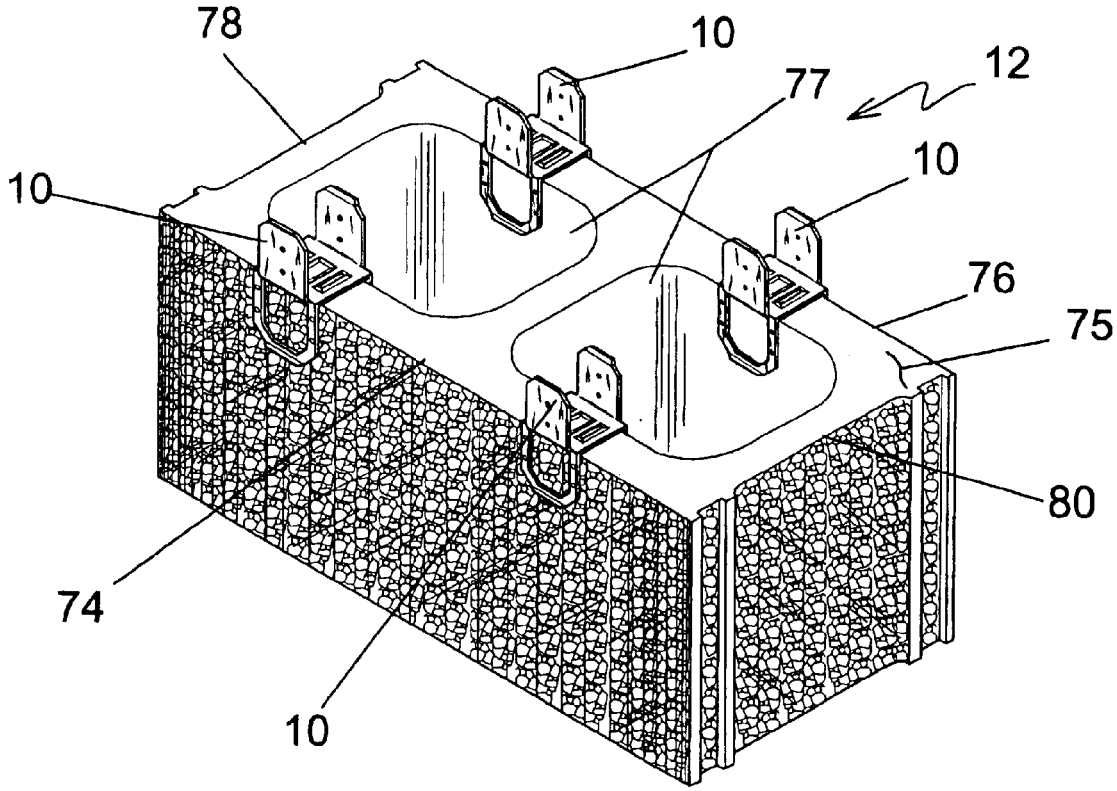
FIG. 7 is a perspective view of the cinderblock alignment clip of the present invention positioned on a side of a cinderblock.

FIG. 7 is a perspective view of the cinderblock alignment clip 10 of the present invention attached to the side walls 74 and 76 of a cinderblock 12. Upon the plurality of clips 10 resting atop a top side of a first cinderblock 12, the first channel is ready to receives at least one of a first and second side wall 74, 76 of a second cinderblock 12. The second cinder block rests upon the spacers 42 on the first side of the center plate 24 of the clip. The gripping knobs 66 on the interior retaining arms 48, 58 grip the at least one of first and second side wall 74, 76 of the second cinderblock 12 thereby aligning the first block with the second block.

Figure 8:
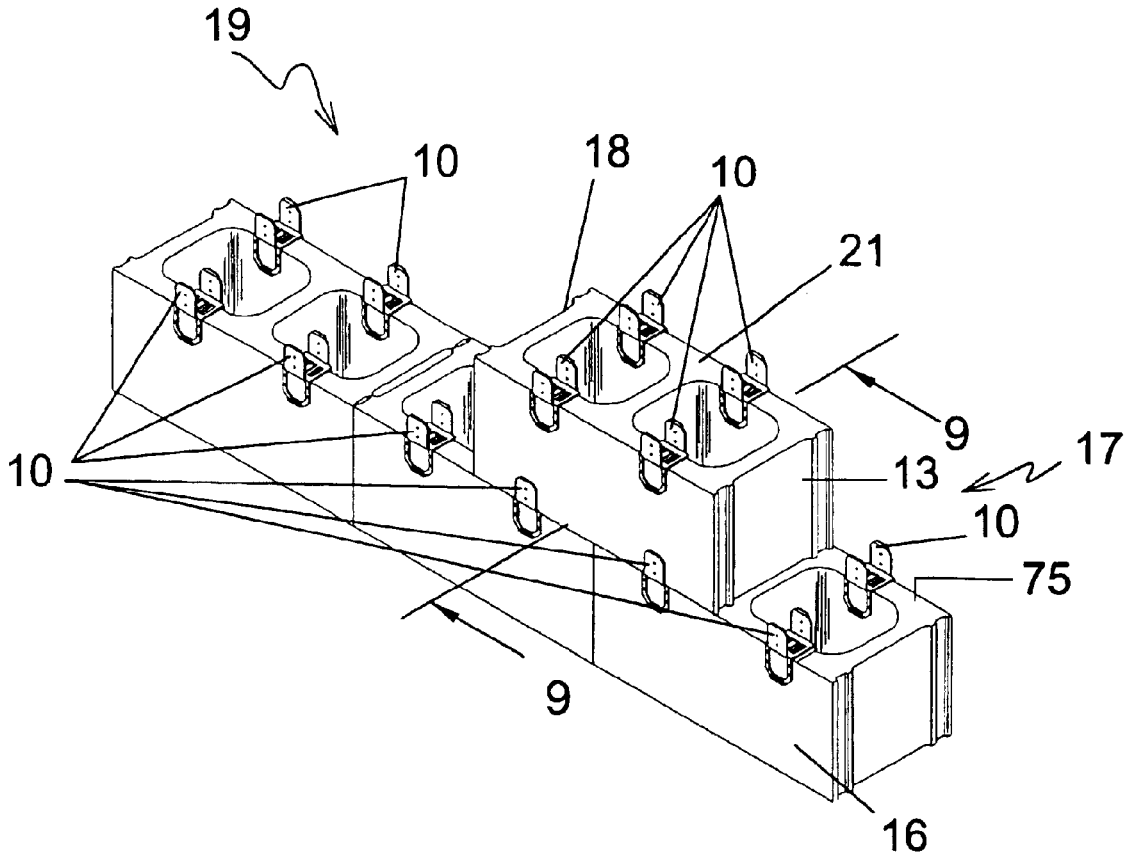
FIG. 8 is an illustrative view of a second course of cinderblocks aligned atop a first course of cinderblocks using a plurality of cinderblock alignment clips of the present invention.

FIG. 8 is an illustrative view of a wall 19 being built by aligning and connecting a second course 18 of cinderblocks 12 atop a first course 16 of cinderblocks 12 using a plurality of alignment clips 10 of the present invention. A first course 16 of cinderblocks 12 is selectively positioned to form an outline of a wall 19. A plurality of clips 10 have been attached to the first course 16 of cinderblocks 12 so that the cinderblocks 12 are received by each respective second channel 72 of each of the respective one of the plurality of clips 10, as described with specific reference to FIG. 6. Each respective first channel 70 of each of the respective one of the plurality of clips 10 is able to receive a second course 18 of cinderblocks 12 can then be received by the first chamber 70 of the clips 10. The second course 18 of a wall 19 is conventionally stacked in a fashion where the center of the cinderblocks 12 in the second course 18 are aligned with the joining ends of a first and second cinderblocks in the first course 16. This pattern is then repeated until the desired height is achieved. In addition to allowing the cinderblocks to be aligned in such a manner, the cinderblocks 12 may be stacked with the ends of the cinderblocks 12 on the second course 18 aligned with the ends of the cinderblocks 12 of the first course 16 for forming a flute or chimney. The clips 10 are versatile because of the simplicity of their design and ease of which they may be positioned on the cinderblocks 10. The use of four clips 10 per cinderblock 12 ensures that the entire cinderblock 12 within a second course 18 is vertically aligned with the first course 16 of cinderblocks 12. Additionally, the use of four clips 10 per cinderblock 12 ensures that a consistent gap is obtained between the first and second course, 16 and 18 respectively, of cinderblocks 12. The clips 10 do not obstruct the central cavity 77 of the cinderblocks 12. An unobstructed central cavity 77 is necessary in the formation of a flute or chimney. Additionally, an unobstructed central cavity 77 allows for the insertion of an insulator or binding agent therein when constructing a wall 19. Often the central cavity 77 of cinderblocks 12 forming a wall 19 is filled with a concrete mixture and rebar for added structural integrity. The clips 10 allow cinderblock to be quickly aligned and stacked without necessitating a skilled mason to do so. The wall 19 is thus quickly built with a consistent vertical alignment and an unobstructed central cavity 77. Once the cinderblocks 12 have been stacked to a desired height a concrete mixture can be poured into the central cavity 77. Upon filling the central cavity 77, the spaces created by the spacers 42, 44 allow for air from the central cavity to be jettisoned therefrom thereby preventing any air gaps from forming therein.

Figure 9:
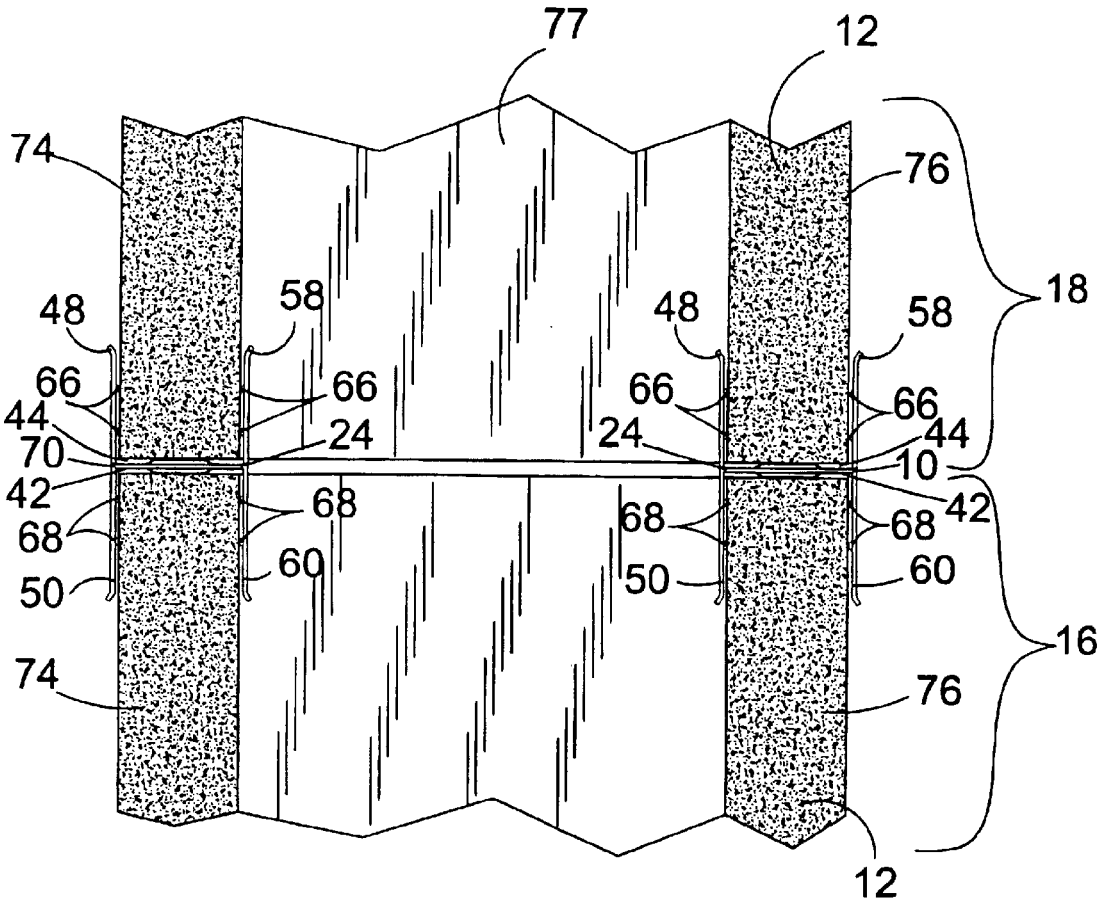
FIG. 9 is a cross sectional view along line 9—9 as drawn in FIG. 8 showing the walls of the cinderblock fit within the cinderblock alignment clips of the present invention.

FIG. 9 is a cross sectional view along line 9—9 as drawn in FIG. 8 showing consecutive courses of cinderblocks connected to each other by the cinderblock alignment clips of the present invention. The clip 10 includes a first chamber 70 and a second chamber 72. The first chamber 70 is formed by the first interior retaining arm 48, the second interior retaining arm 58, and the center plate 24. The first and second retaining arms, 48 and 58 respectively, extend substantially perpendicular to the center plate 24. At an end of the first interior retaining arm 48 opposite the center plate 24 the interior retaining arms 48 is bent away from the center of the first cavity 70 thereby forming the first interior lips 54. At an end of the second interior retaining arms 54 opposite the center plate 24 the second interior retaining arm 58 is bent away from the center of the first cavity 70 thereby forming second interior lips 64. The lips, 54 and 64, create an opening which is wider than the width of the first cavity 70, thus allowing for the easy insertion of cinderblocks therein. On each interior retaining arm, 48 and 58, is a plurality of gripping knobs 66 extending vertically into the first cavity 70. The gripping knobs 66 ensure a snug fit and add surface tension for grabbing a cinderblock placed within the first chamber 70. A first spacer 42 vertically extends into the first cavity 70 from the center plate 24. When the cinderblock is placed within the first chamber 70, the cinderblock will rest upon the first spacer 42 thereby leaving a gap between the cinderblock and the center plate 24 for air and other fluids to pass therebetween.

The second chamber 72 is formed by the first exterior retaining arm 50, the second exterior retaining arm 60, and the center plate 24. The first and second external retaining arms, 50 and 60 respectively, extend substantially perpendicularly from the center plate 24 in a direction opposite the first interior retaining arms. At the end of the first exterior retaining arm 50 opposite the center plate 24, the first exterior retaining arm 50 is bent away from the center of the second cavity 72, forming the first exterior lip 62. At the end of the second exterior retaining arm 60 opposite the center plate 24 the second exterior retaining arm 60 are bent away from the center of the second cavity 72 forming the second exterior lips 64. The exterior lips, 62 and 64, create an opening which is wider than the width of the second cavity 72 thereby allowing for the easy insertion of a cinderblock therein. On each exterior retaining arm, 62 and 64, is a plurality of gripping knobs 68 extending into the second cavity 72. The gripping knobs 68 ensure a snug fit and add surface tension for grabbing a cinderblock placed within the second chamber 72. A second spacer 44 extends vertically into the second chamber 72 from the center plate 24. When the wall of a cinderblock is placed within the second chamber 72, the cinderblock will rest upon the second spacer 44. This gap created by the second spacer 44 between the cinderblock and the center plate 24 allows air and other fluids to pass therebetween. The center plate 24 serves as a common divider between the first and second chambers, 70 and 72 respectively, with the second chamber 72 positioned directly opposite the first chamber 70. A small gap equal to the sum of the distance the first spacer 42 extends upward from the first side of the center plate 24 and the distance the second spacer 44 extends upward from the second side of the center plate 24 is formed between the cinderblock 12 of the first course 16 and the cinderblock 12 of the second course 18. This gap allows for air to escape the center cavity 77 of the cinderblocks 12 when a binding agent other fluid is poured therein. Thus, the central cavity 77 can be filled while substantially eliminating the creation of air pockets thereby creating a stronger wall 19.

It will be understood that each of the elements described above, or two or more together may also find a useful application in other types of apparatuses differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A cinderblock wall comprising:

a) a plurality of cinderblocks, each of said cinderblocks having side and end walls and a center wall defining first and second cavities extending through said cinderblock;

b) a plurality of cinderblock alignment clips interconnecting the initial course of cinderblock to the subsequent course of cinderblock, each of said plurality of clips comprising:

a) a flat center plate having a first end and a second end, said center plate up against a top surface of a side wall of a fist cinderblock;

b) a first retaining arm having a first portion and a second portion, both said first portion and said second portion are connected to said first end, said first portion extends in a direction on a side of said center plate opposite said second portion so that said first portion rests against an outer side wall of said side wall of said first cinderblock and said second portion rests against an outer side of a side wall of a second cinderblock in an adjoining course of cinderblocks;

c) a second retaining arm having a third portion and a fourth portion, both said third portion and said fourth portion are connected to said second end, said third portion extends in a direction on a side of said center plate opposite said fourth portion, so that said third portion rests against an opposite side of said side wall in a cavity of said first cinderblock and said fourth portion rests against an opposite side of the side wall in a cavity of said second cinderblock in said adjoining course of cinderblocks, wherein each clip is positioned between staggered cinderblocks in stacked courses of said cinderblocks.

2. The cinderblock wall as recited in claim 1, further comprising a concrete mixture poured into a central cavity of said plurality of cinderblocks.

3. The cinderblock wall as recited in claim 1, further comprising a plurality of rebar within said central cavity of said plurality of cinder blocks.

4. The cinderblock wall as recited in claim 1, wherein said first portion and said second portion of each of said plurality of clips are pivotable about said first end of said centerplate, and said third portion and said fourth portion of said plurality of clips are pivotable about said second end of said center plate.

5. The cinderblock wall as recited in claim 1, wherein said plurality of clips further comprise a plurality of surface tension knobs extending from a surface of at least one of said first, second, third, and fourth portions for gripping a wall of the cinderblock.

6. The cinderblock wall as recited in claim 1, wherein said plurality of clips further comprise a first spacer positioned on a first side of said center plate and extending a first predetermined distance from said first side of said center plate, and a second spacer positioned on a second side of said center plate and extending a second predetermined distance from said second side of said center plate, wherein said first and second spacers form a gap between cinderblocks positioned on either side of said center plate.

7. The cinderblock alignment clip as recited in claim 1, further comprising a lip connected to an end of at least one of said first, second third and fourth portions of said plurality of clips, said end is furthest from a respective connection between said one of said portions and said center plate.

* * * * *